US012157204B2

(12) United States Patent
Horl et al.

(10) Patent No.: US 12,157,204 B2
(45) Date of Patent: Dec. 3, 2024

(54) ROLLING GRINDER WITH PRESS FIT BETWEEN ROLLER AND SHAFT

(71) Applicant: Horl 1993 GmbH, Freiburg (DE)

(72) Inventors: Otmar Horl, Freiburg (DE); Timo Horl, Freiburg (DE)

(73) Assignee: HORL 1993 GMBH (DE)

( * ) Notice: Subject to any disclaimer, the term of this patent is extended or adjusted under 35 U.S.C. 154(b) by 0 days.

(21) Appl. No.: 18/044,333

(22) PCT Filed: Sep. 8, 2021

(86) PCT No.: PCT/EP2021/074715
§ 371 (c)(1),
(2) Date: Mar. 7, 2023

(87) PCT Pub. No.: WO2022/053517
PCT Pub. Date: Mar. 17, 2022

(65) Prior Publication Data

US 2023/0294246 A1 Sep. 21, 2023

(30) Foreign Application Priority Data

Sep. 9, 2020 (DE) ..... 10 2020 123 501.1

(51) Int. Cl.
*B24D 7/16* (2006.01)

(52) U.S. Cl.
CPC ..... *B24D 7/16* (2013.01)

(58) Field of Classification Search
CPC ..... B24D 7/16; B24B 23/024
See application file for complete search history.

(56) References Cited

U.S. PATENT DOCUMENTS

| | | | |
|---|---|---|---|
| 4,070,742 | A | 1/1978 | Dorfman |
| 6,425,813 | B1 | 7/2002 | Ernst |
| 7,724,611 | B2 | 5/2010 | Groothuis et al. |
| 2003/0166386 | A1 | 9/2003 | McDonald |

FOREIGN PATENT DOCUMENTS

| | | | |
|---|---|---|---|
| CA | 2053032 | A1 | 4/1992 |
| DE | 1652891 | A1 * | 1/1970 |
| DE | 9116059 | U1 | 2/1992 |

(Continued)

OTHER PUBLICATIONS

English translation DE1652891 (Year: 1970).*

(Continued)

*Primary Examiner* — Jason L Vaughan
*Assistant Examiner* — Amanda Kreiling
(74) *Attorney, Agent, or Firm* — Harness, Dickey & Pierce, P.L.C.

(57) ABSTRACT

A method for producing a rolling sharpener having at least one grinding or polishing face for grinding and/or polishing a cutting tool, the rolling grinder being formed substantially from two rollers, a grip body to be arranged between the rollers and rotatably relative thereto, and a shaft to be supported rotatably in the grip body. To make correct operation of the rolling grinder user-friendly and to facilitate correct operation overall, each of the rollers is connected to the shaft in a frictionally engaged manner.

23 Claims, 2 Drawing Sheets

(56) References Cited

FOREIGN PATENT DOCUMENTS

| | | | | |
|---|---|---|---|---|
| DE | 29909982 | U1 | 9/1999 | |
| DE | 102016009482 | A1 | 2/2018 | |
| DE | 202020001180 | U1 * | 6/2020 | |
| EP | 3278928 | A2 * | 2/2018 | ..... B24B 3/543 |
| GB | 437733 | A | 10/1935 | |
| WO | 2011123382 | A1 | 10/2011 | |

OTHER PUBLICATIONS

English translation EP3278928 (Year: 2018).*
English translation DE202020001180 (Year: 2020).*
International Search Report for PCT/EP2021/074644, mailed on Dec. 23, 2021, 2 pages.
Office Action for corresponding Japanese Patent Application No. 2023-515583 dated Jun. 4, 2024 (9 pages).
Office Action for corresponding Canadian Patent Application No. 3,192,888 dated Jun. 26, 2024 (5 pages).
Office Action issued in corresponding Korean Patent Application No. 10-2023-009376 dated Sep. 14, 2024, with English translation of Summary of Grounds for Rejection (10 pages total).
Author: Horl 1993 Title: Unterschiedliche Küchenmesser schärten mit dern Rollscheiter vol Horl—1993 Relevant Portion: Product video and the video description which provides Dec. 15, 2017 as the video release date. Publication Date: Dec. 15, 2017 Publisher: youtube.com Place of publication: https:www.youtube.com/watch?v=qZy7lwFVZxy.†
Author:Horl—1993 Title: Horl—1993 HR2 Horl Rotary Grinder Knife Sharpener Oak &Magnetic Grinding Guide No Relevant Portion: Product images and product information which provides Dec. 31, 2016 as the firest date available. Publication Date: Dec. 31, 2016 Publisher: Amazon.com Place of publication: https://www.amazon.de/-/en/Horl-1993-HR2-Sharpener-Magnetic-Grinding/dp/B01NCRM2HL.†

* cited by examiner
† cited by third party

ROLLING GRINDER WITH PRESS FIT BETWEEN ROLLER AND SHAFT

CROSS-REFERENCE TO RELATED APPLICATIONS

The present application is a U.S. National Phase of International Application No. PCT/EP2021/074715, filed Sep. 8, 2021, which claims priority to German Application No. 10 2020 123 501.1, filed Sep. 9, 2020.

BACKGROUND

The present disclosure relates to a method for producing a rolling grinder having at least one grinding or polishing face for grinding and/or polishing a cutting tool, the rolling grinder being formed substantially from two rollers, a grip body to be arranged between the rollers and rotatably relative thereto, and a shaft to be supported rotatably in the grip body.

A rolling grinder is known, for example, from EP 3 278 928 A. Said rolling grinder is intended to be brought with its grinding or polishing face into contact with a cutting edge of the cutting tool to be ground and moved along the cutting edge in a rolling movement over a planar base. The end face grinding or polishing face rotates in a grinding plane aligned perpendicular to the substrate and removes material from the cutting edge.

In the rolling grinder known from EP 3 278 928 A, the rollers and grinding or polishing wheels are bolted to the shaft so that the rolling grinder can be easily disassembled into its individual parts. When dismantling the grinding or polishing wheels from the shaft, the user must hold the rollers firmly, otherwise they will come loose from the shaft. Due to the fact that the rolling grinder can be disassembled, cleaning is easier, but handling is more difficult for the user.

Embodiments discussed herein are based on the problem of improving the known rolling grinder to the extent that operation of the rolling grinder in accordance with its intended use is made user-friendly and is facilitated overall.

Some embodiments provide a method for producing a rolling grinder. The method may serve to produce a rolling grinder with at least one grinding or polishing face for grinding and/or polishing a cutting tool, wherein the rolling grinder is substantially formed from two rollers, a grip body to be arranged rotatably between the rollers and relative thereto, and a shaft to be rotatably supported in the grip body. According to some embodiments, each of the rollers is connected to the shaft in a frictionally engaged manner. This means that the rollers, the grip body and the shaft form an integral unit and ideally cannot be detached from each other without causing damage. As a result, the rolling grinder can be produced with little effort and is user-friendly overall, since the components of the rolling grinder are captively held together.

It can be advantageous if one or both of the rollers is/are connected to the shaft in a frictionally engaged manner only. For this exclusively frictional connection between each roller and the shaft, in particular, no separate fastening means are required. This reduces the number of components required and, accordingly, the effort required to produce the rolling grinder.

It may prove useful if one or both of the rollers is/are connected to the axle by press-fitting. After press-fitting, an interference fit is created at the joints between the roller and the shaft. This means that longitudinal and transverse forces can be transmitted in a frictionally engaged manner. This allows a cylindrical interference fit to be created between the roller and the shaft. In order to achieve a longitudinal press-fit, the roller is pressed onto the shaft under high axial force (for example with a hydraulic press). The average surface roughness of the roller and/or the shaft is preferably in the range of Rz from 3 to 10 μm. In order to facilitate press-fitting, an insertion bevel or chamfer on the shaft and/or on the roller is preferred.

It may be useful to have one or both of the rollers for connection to the shaft with a temperature difference to the shaft. For example, the roller is heated and/or the shaft is cooled before assembly. This causes the roller to expand or the shaft to shrink, which enables the two parts to be joined without or with greatly reduced force. During the subsequent temperature equalization, the pressing is adjusted while the surface roughness is largely retained, resulting in a much tighter fit than with longitudinal press-fitting.

It may prove practicable if one or both of the rollers is/are fitted onto the shaft or inserted into the shaft. In a preferred embodiment, the roller has a bore, in particular a through-hole, and the shaft has a support section that fits into the bore. In this respect, the roller forms the "female" component and the shaft the "male" component. However, it is also possible that the shaft forms the "female" component and has a bore, and the roller as the "male" component comprises a support section that fits into the bore.

It can be helpful if a stepped shaft with a center section and two support sections stepped at the ends is used as the shaft. For axial positioning of the roller relative to the shaft, the center section is preferred as a position limit, for example in the form of a shoulder.

It can be advantageous if a rolling bearing and one of the rollers, and optionally a spacer element, are arranged on each support section, preferably such that the rolling bearing is supported axially with its inner ring on the center section of the shaft and/or the spacer element is fixed axially between the rolling bearing and the roller. In this respect, the center section of the shaft is used as a position limit for the roller on the shaft. With this configuration, the position of the roller relative to the shaft can be set particularly accurately.

It may prove useful if the rolling bearing is fixed to the grip body with its outer ring by frictional and/or form-fit locking. In this way, the position of the shaft relative to the grip body can be precisely adjusted.

It may be useful if one or both of the rollers has/have a grinding or polishing face non-detachably disposed thereon, preferably on the end face, wherein the grinding or polishing face is preferably integrally formed with or non-detachably connected to the roller, wherein the grinding or polishing face is particularly preferably configured as a coating, in particular as a ceramic coating. In this variant, the rolling grinder has a minimum number of components. This facilitates production and handling for the user.

However, it can also be convenient if a grinding or polishing wheel provided with the grinding or polishing face is attached to one or both of the rollers, preferably in a detachable manner. This variant is particularly suitable for more experienced users who wish to use interchangeable grinding or polishing wheels. This makes the rolling grinder more versatile.

Preferably, the grip body has at least one of the following features.

- the grip body is made of plastic and/or metal and/or wood, preferably oak, walnut, beech or spruce, preferably in one piece.

the grip body is configured as a cylinder, preferably a hollow cylinder.

An independent aspect relates to a rolling grinder having two rollers and a grip body disposed therebetween, wherein the rollers are connected to a shaft in a frictionally engaged manner rotatably supported in the grip body. The rollers each have a grinding or polishing face on the end face thereof.

Further preferred embodiments result from combinations of the features disclosed, the description and the Figures.

DETAILED DESCRIPTION OF THE PREFERRED EMBODIMENTS

Preferred embodiments are described in detail below with reference to the accompanying drawings.

Figure 1:
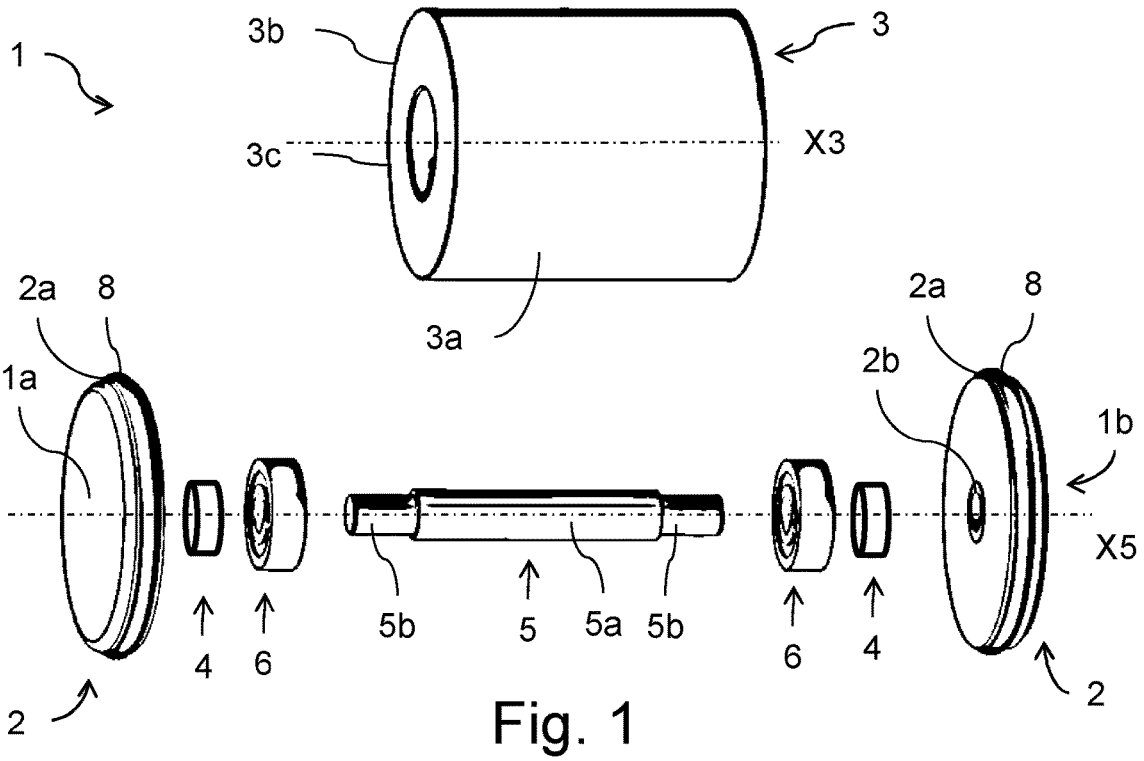
FIG. 1 shows a perspective exploded view of a rolling grinder according to the first embodiment, which can be produced by the method discussed herein.
Figure 3:
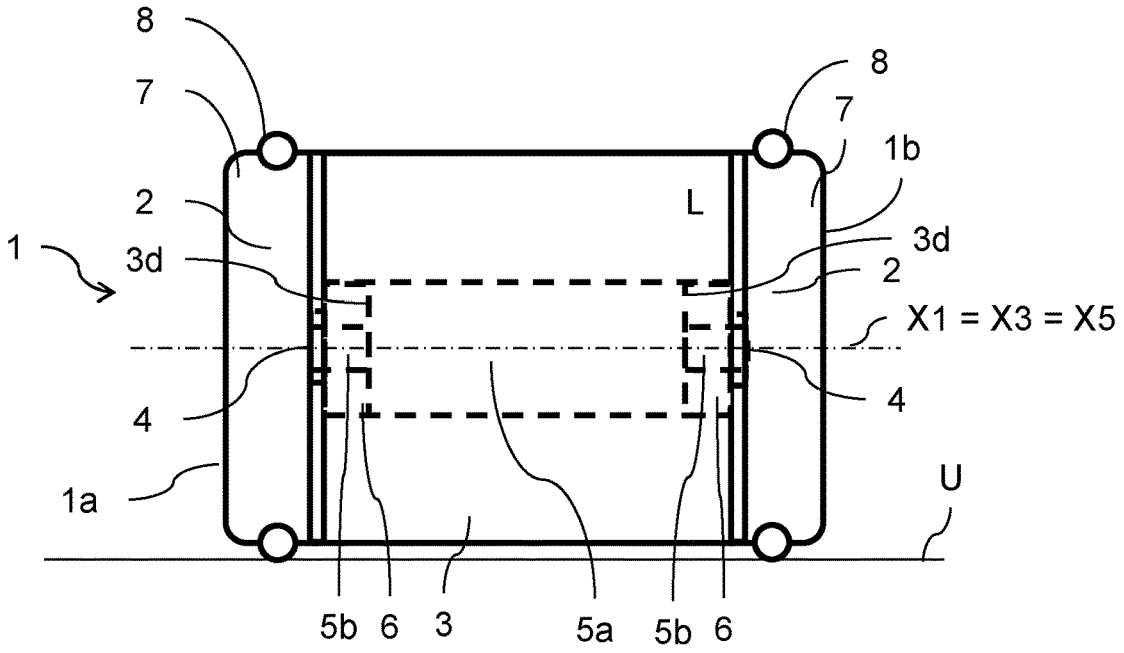
FIG. 3 shows a schematic view of the rolling grinder according to the first embodiment in an assembled state.

First Embodiment (FIGS. 1 and 3)—Rollers with Integral Grinding/Polishing Face In the first embodiment, described below with reference to FIGS. 1 and 3, the rolling grinder 1 is constructed from a total of 10 or 12 components and includes two rollers 2, a grip body 3 (optionally with two bearing sleeves, not shown), two spacer elements 4, a shaft 5, two rolling bearings 6 (each counting as one component), and two rubber rings 8 arranged on the edges of the rollers 2 to form the running faces of the rollers 2.

Each roller 2 is approximately configured as a cylindrical disc made of stainless steel and includes a circumferential annular groove in the cylindrical shell surface 2*a*, in which the rubber ring 8 is held in a form-fitting manner. The thickness or axial length of the roller 2 is, for example, in the range of 2 to 10 mm, in particular about 8 mm, while the outer diameter (without rubber ring 8) is, for example, in the range of 40 to 60 mm, in particular about 54 mm. The rubber ring 8 preferably has an oval cross-section, the main axis of which is preferably aligned parallel to the shell surface 2*a* of the roller 2. An integrally formed grinding or polishing face 1*a*, 1*b* is located on the intended end face of each roller 2. The transition from the circumferential side 2*a* provided with the annular groove to the end face of the roller 2 is rounded or chamfered, wherein the radius of curvature of the rounding is in the range of 0.5 to 2 mm, in particular approx. 1 mm. The side of the roller 2 facing the grip body 3 as intended has a center opening 2*b* with which the roller 2 is fitted onto a shaft 5 described below.

The grip body 3 is a hollow cylinder made of wood extending along a center axis X3 and having a cylindrical shell surface 3*a*, two parallel end faces 3*b* and a cylindrical center bore 3*c*. In one variant, the center bore 3*c* of the grip body 3 (see FIG. 3) comprises two sections with different diameters, namely a center section with a smaller diameter and end-side end sections with larger diameters. Two parallel and outwardly pointing bearing support sections 3*d* are formed on the end face of the center section for axial support of rolling bearings 6. These bearing support sections 3*d* determine the position of the rollers 2 relative to the grip body 3. In an alternative variant, the grip body 3 comprises a center bore 3*a* of uniform diameter. For fixing the rolling bearings 6 described below, a bearing sleeve (not shown) is inserted from each end face 3*a* of the grip body 3 into the center bore 3*a*, which bearing sleeve is supported by a flange on the end face 3*a* of the grip body 3 and forms a bearing support section 3*d* on a base. The base of the bearing sleeve is provided with an opening for insertion of the shaft 5. For particularly high-quality configurations, the grip body 3 is produced in one piece from oak wood, walnut wood, beech wood or spruce wood. The outer diameter of the grip body 3 preferably corresponds to the outer diameter of the roller 2 (without rubber ring 8), so that the shell surface 3*a* of the grip body 3 and the shell surfaces 2*a* of the rollers 2 are flush with each other in the intended assembly state (see FIG. 3). At the time of production of the grip body 3, the moisture content of the wood should be as low as possible and not exceed 10%. The outer diameter of the grip body 3 is, for example, in the range of 50 to 60 mm and in the present case is approx. 54 mm. The axial length of the grip body 3 is, for example, in the range from 55 to 75 mm and in the present case is approx. 64 mm.

The shaft 5 is configured as a stepped shaft 5 with a center section 5*a* and bearing sections 5*b* stepped at the ends.

The rolling bearing 6 is, for example, a commercially available ball bearing. The inner diameter of the inner ring of the rolling bearing 6 is matched to the outer diameter of the bearing section 5*b* of the shaft 5 and can be arranged on this, so that the inner ring is supported in the axial direction on the center section 5*a* of the shaft 5. The outer diameter and axial length of the rolling bearing 6 are matched to the dimensions of the grip body 3. The rolling bearing 6 can therefore be inserted precisely into the center bore or bearing sleeve of the grip body 3 and be supported axially with the outer ring on the bearing support section 3*d*.

The spacer element 4 is, for example, an annular disc or cylindrical sleeve which can be slid onto the bearing section 5*b* of the shaft 5 in order to be supported on the inner ring of the rolling bearing 6 and a roller 2. Different types of spacer elements 4 are provided, which have different axial lengths in order to precisely adjust the distance between the rollers 2 to be attached to the shaft 5, depending on the actual dimensions of the grip body 3—and thus the gap dimension between each roller 2 and the grip body 3.

In the assembled state, the shaft 5 and the spacer elements 4, rolling bearings 6 and rollers 2 connected to it have a common center or rotational axis X5.

The rolling grinder 1 is assembled from the above components by fitting a rolling bearing 6, a spacer element 4 and a roller 2 onto each bearing section 5*b* of the shaft 5 extending through the center bore 3*c* of the grip body 3, so that the inner ring of the rolling bearing 6 is supported on the center section 5*a* of the shaft 5 and the spacer element 4 is fixed between the inner ring of the rolling bearing 6 and the inside of the roller 2. The roller 2 is then firmly and non-detachably connected to the shaft 5 by press-fitting, so that an interference fit is produced at the connection points. The outer ring of the rolling bearing 6 is fixed to the grip body 3 by frictional locking and, if necessary, by form-fit locking.

Figure 2:
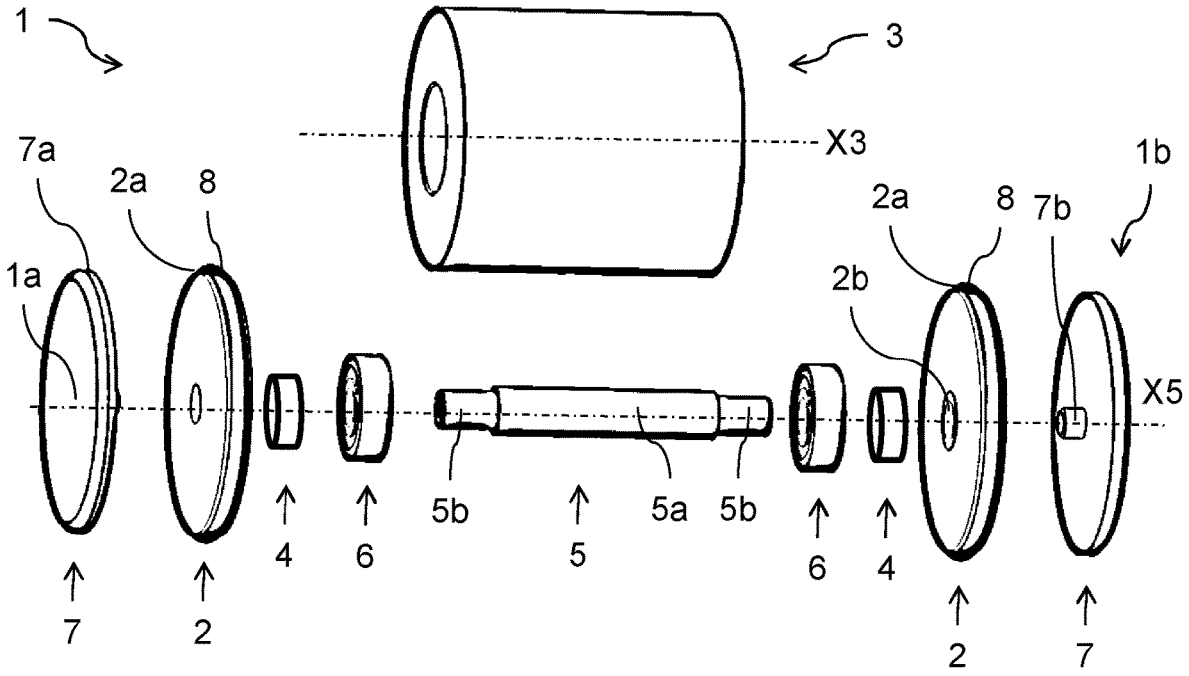
FIG. 2 shows a perspective exploded view of a rolling grinder according to the second embodiment, which can be produced according to the method discussed herein.
Figure 4:
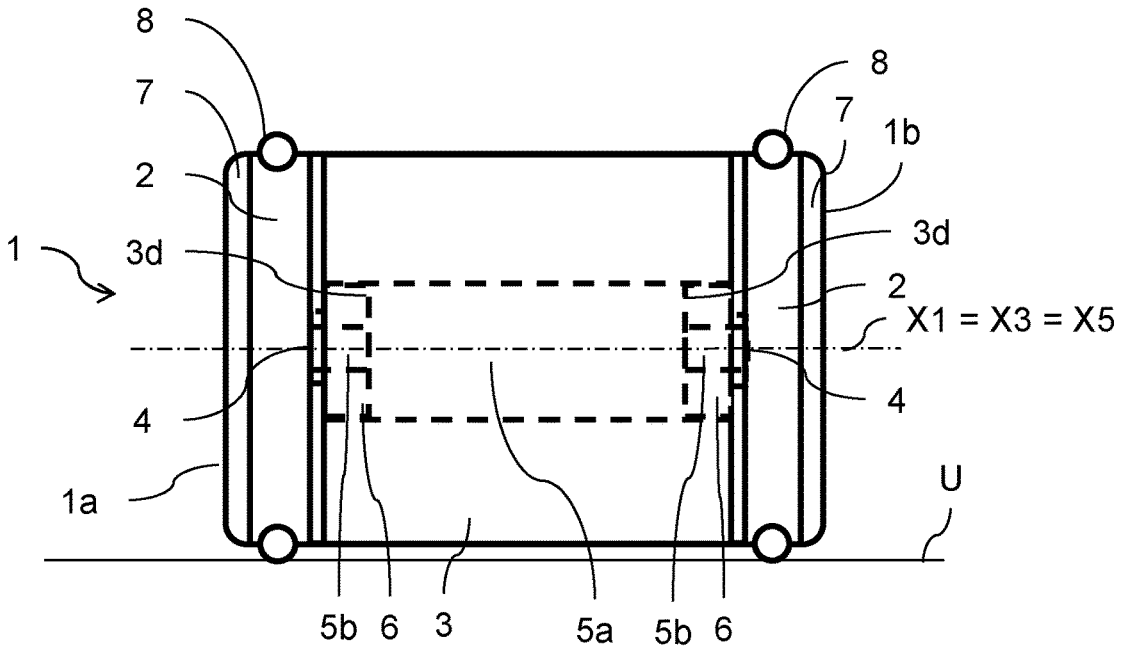
FIG. 4 shows a schematic view of the rolling grinder according to the second embodiment in an assembled state.

Second Embodiment (FIGS. 2 and 4)—Rollers with Separate Grinding/Polishing Roller In the second embodiment, described below with reference to FIGS. 2 and 4, the rolling grinder 1 comprises substantially the same components and features as the rolling grinder 1 of the first embodiment, except for the differences mentioned below:

Whereas in the first embodiment the grinding and polishing faces 1*a*, 1*b* are integrally formed at the end faces with the rollers 2 and are thus an integral part of the rolling grinder 1, the rolling grinder 1 according to the second embodiment comprises separate grinding and polishing wheels 7, on the end faces of which the grinding and polishing faces 1*a*, 1*b* are formed. The grinding and polishing wheels 7 can be detachably connected to the roller 2 or to the shaft 5 by screwing integrally formed threaded sockets 7*b* into corresponding mating threads. In deviation from the first embodiment, the rollers 2 are not chamfered or rounded on the outward-facing end face, so that the shell surfaces 7*a* of the grinding and polishing wheels 7 merge flush with the shell surface 2*a* of the respective adjacent roller 2. Instead, the grinding and polishing wheels 7 are chamfered or rounded at the transition between the shell surface 7*a* and the respective grinding or polishing face 1*a*, 1*b*. The radius of curvature at the end face of the grinding or polishing wheel 7 is in the range of 0.5 mm to 2 mm, for example, and is preferably approx. 1 mm.

LIST OF REFERENCE SIGNS

1 rolling grinder
1*a* grinding face
1*b* polishing face
2 roller
2*a* shell surface or circumferential side
2*b* opening
3 grip body
3*a* shell surface
3*b* end face
3*c* bore
3*d* support section
4 spacer element
5 shaft
5*a* center section
5*b* bearing section
6 rolling bearing
7 grinding and polishing wheels
7*a* shell surface
7*b* threaded socket
8 rubber ring
U base
X1 rotary/center axis rolling grinder
X3 rotary/center axis grip body
X5 rotary/center axis of shaft, rolling bearing, grinding and polishing wheel, if applicable

What is claimed is:

1. A method for producing a rolling grinder having at least one grinding or polishing face for grinding or polishing a cutting tool, comprising:

connecting two rollers to a shaft such that the rollers and the shaft are frictionally engaged, wherein each of the rollers is connected to the shaft by press-fitting, wherein a grip body is arranged between the rollers and rotatable relative to the rollers, and wherein the shaft is rotatably supported in the grip body.

2. The method according to claim 1, wherein at least one of the rollers is connected to the shaft in a frictionally engaged manner only.

3. The method according to claim 1, wherein the shaft or one of the rollers comprises an insertion bevel or chamfer to facilitate press-fitting.

4. The method according to claim 1, wherein an interference fit between the roller and the shaft is cylindrical.

5. The method according to claim 1, wherein at least one of the rollers has a temperature difference to the shaft.

6. The method according to claim 1, wherein at least one of the rollers is inserted into the shaft.

7. The method according to claim 6, wherein the shaft forms a female component and comprises a bore, and wherein each of the rollers forms a male component and comprises a support section fitting in the bore.

8. The method according to claim 1, wherein at least one of the rollers comprises a grinding or polishing face non-detachably arranged at an end face of the roller.

9. The method according to claim 8, wherein the grinding or polishing face is integrally formed with the roller.

10. The method according to claim 9, wherein the grinding or polishing face comprises a ceramic coating.

11. The method according to claim 1, wherein the grip body is made of wood.

12. The method according to claim 1, wherein the grip body is made of oak wood, walnut wood, beech wood, or spruce wood in one piece.

13. The method according to claim 1, wherein the grip body is a hollow cylinder.

14. The method according to claim 1, wherein an outer diameter of the grip body is in the range of 50 to 60 mm.

15. The method according to claim 1, wherein an axial length of the grip body is in the range of 55 to 75 mm.

16. The method according to claim 1, wherein each of the rollers is a cylindrical disc.

17. The method according to claim 1, wherein each of the rollers is formed of stainless steel.

18. The method according to claim 1, wherein each of the rollers comprises a circumferential annular groove on a circumferential side thereof and a rubber ring fitted in the circumferential annular groove.

19. The method according to claim 18, wherein each of the rollers comprises a rounded or chamfered transition from the circumferential side provided with the annular groove to an end face of the roller.

20. The method according to claim 1, wherein an outside diameter of each of the rollers is in the range of 40 to 60 mm.

21. The method according to claim 1, wherein each of the rollers is connected to the shaft by press-fitting in a frictionally engaged manner, wherein each of the rollers is inserted into the shaft, wherein the shaft forms a female component and has a bore, and wherein each of the rollers forms a male component and comprises a support section fitting into the bore.

22. The method of claim 21, wherein an insertion bevel or chamfer is formed on said roller to facilitate said press-fitting.

23. A method for producing a rolling grinder having at least one grinding or polishing face for grinding or polishing a cutting tool, comprising:

connecting two rollers to a shaft such that the rollers and the shaft are frictionally engaged, wherein each of the rollers is connected to the shaft by press-fitting, wherein a grip body is arranged between the rollers and rotatable relative to the rollers, wherein the shaft is rotatably supported in the grip body, wherein each of the rollers is inserted into the shaft, wherein the shaft forms a female component and comprises a bore, and wherein each of the rollers forms a male component and comprises a support section configured to fit in the bore.

* * * * *